US006511345B1

(12) United States Patent
Hwang

(10) Patent No.: US 6,511,345 B1
(45) Date of Patent: Jan. 28, 2003

(54) GUIDE RAIL ASSEMBLY FOR RECEIVING OPTOELECTRONIC MODULES

(75) Inventor: Jeng-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/976,933

(22) Filed: Oct. 11, 2001

(51) Int. Cl.[7] ..... H01R 13/60
(52) U.S. Cl. ..... 439/541.5; 439/607; 439/79
(58) Field of Search ..... 439/607–609, 439/541.5, 701, 79

(56) References Cited

U.S. PATENT DOCUMENTS 6,120,322 A * 9/2000 Ho et al. ..... 439/541.5
6,159,040 A * 12/2000 Cahng et al. ..... 439/541.5
6,296,518 B1 * 10/2001 Avery et al. ..... 439/541.5
6,358,067 B1 * 3/2002 Takase et al. ..... 439/79

* cited by examiner

*Primary Examiner*—Hien Vu
(74) *Attorney, Agent, or Firm*—Wei Te Chung

(57) ABSTRACT

A guide rail assembly (1) having two guide rails (10, 30) stacked one above the other and mountable onto one printed circuit board (PCB) (2) is designed for receiving two opto-electronic modules. A mounting device (20) fixes the guide rails in fixed relation to one another and onto the PCB. The guide rails are identical to one another and each includes a frame (11) for receiving an optoelectronic module and a metallic cover (12) for providing EMI shielding to the optoelectronic module. The mounting device includes four posts (21) which fix the lower guide rail to the PCB and elevate the upper guide rail above the lower guide rail. Fastener members (22) fix the upper guide rail securely to the posts.

5 Claims, 4 Drawing Sheets

GUIDE RAIL ASSEMBLY FOR RECEIVING OPTOELECTRONIC MODULES

BACKGROUND OF THE INVENTION

1. Field of the Invention

The present invention relates to a guide rail assembly for receiving optoelectronic modules therein, wherein the guide rail assembly comprises a plurality of stacked guide rails.

2. Description of the Related Art

U.S. Pat. No. 5,879,173, issued to Poplawski et al. on Mar 9, 1999, discloses a receptacle or guide rail for receiving a removeable optoelectronic module therein. FIGS. 10, 15, and 16 disclose a guide rail 372 having a box configuration, while FIGS. 14, 17 and 18 disclose another type of guide rail. U.S. Pat. No. 5,767,999, issued to Kayner on Jun. 16, 1998, discloses another type of guide rail for receiving a removeable optoelectronic module therein. Both Poplawski et al. and Kayner disclose an electrical connector adapted for electrically engaging with an optoelectronic module received in the guide rail. Both electrical connectors are mounted on a printed circuit board by soldering and do not engage with the associated guide rail, so are not supported by the guide rail. Therefore, when an optoelectronic module mates with these electrical connectors, the mounting tails of the contacts of these electrical connectors are subject to a force by the optoelectronic module which may destroy the connection between the mounting tails and the mounting pads on the printed circuit board.

U.S. Pat. No. 6,047,172, issued to Babineau et al. on Apr. 4, 2000, suggests an arrangement of guide rails in two rows, as shown in FIG. 2 of Babineau. (Note that only one layer is clearly illustrated.) The upper guide rails would be mounted on an upper printed circuit board, while the lower guide rails would be mounted on a lower printed circuit board. Although Babineau et al. suggests the idea of arranging the guide rails in two different levels, the implementation of this idea is not cost effective because two different printed circuit boards are required.

U.S. Pat. No. 6,276,963, issued to Avery et al. on Aug. 21, 2001, suggests a stacked arrangement of guide rails with one guide rail above another guide rail. However, the structures of said two guide rails are different, so it is necessary to manufacture the upper and lower guide rails using two different dies. The implementation is not cost-efficient. In addition, corresponding electrical connectors only mount to a printed circuit board and do not engage with the guide rails; therefore, Avery et al. has the same problem as Poplawski et al.

U.S. Pat. No. 6,272,019, issued to Edwards et al. on Aug. 7, 2001, discloses two GBIC guide rails mounted in back-to-back fashion on opposite sides of a connector plate, as shown in FIG. 3 of Edwards. This solution has complications of its own, and requires inverse insertion of optoelectronic modules therein.

Hence, an improved guide rail assembly which firmly supports connectors contained within the guide rail assembly and which provides convenient and cost effective stacking of two guide rails, one above the other, is desired.

SUMMARY OF THE INVENTION

An object of the present invention is to provide a guide rail assembly which firmly supports electrical connectors included therein.

Another object of the present invention is to provide a guide rail assembly in which two guide rails can be stacked one above the other and mounted on the same printed circuit board.

A further object of the present invention is to provide a guide rail assembly in which the structure of each guide rail frame is identical in order to simplify manufacturing.

To obtain the above objects, a guide rail assembly mountable onto a printed circuit board and adapted for receiving two optoelectronic modules therein comprises two guide rails, two electrical connectors, and a mounting device. The two guide rails are identical in construction and can be stacked one above the other using the mounting device. Each guide rail comprises a frame with a metallic cover, a door, and a pair of grounding plates attached to the frame. Each frame has two side beams and a rear beam connecting the side beams, thereby defining a receiving space between the two side beams and the rear beam for receiving an associated electrical connector and for accepting an optoelectronic module therein. Each frame defines a port in a front portion thereof for entrance of the optoelectronic module. The side beams each define a receiving slot in an inner wall thereof. A pair of side lugs is integrally formed on an outside surface of each side beam.

Each electrical connector has a mating portion adapted for mating with the optoelectronic module and a mounting portion adapted for mounting to a printed circuit board. The electrical connectors each have a pair of ribs at opposite sides thereof for engaging in corresponding receiving slots in the side beams of the associated frame. The ribs thereby fix the connectors in the respective guide rails. Further engagement between each electrical connector and its associated guide rail is provided by an ear portion at a top of each connector which engages with a hook formed on the associated metallic cover, which is mounted on the frame of each guide rail. Thus, the two electrical connectors mechanically engage with and are supported by an associated guide rail.

The mounting device comprises four elongate posts and four fastener members. The elongate posts fix a lower of the two guide rails to the printed circuit board by fixing each side lug of the lower frame to the printed circuit board. The elongate posts also elevate the upper of the two guide rails above the lower of the two guide rails. The fastener members fix the side lugs of the upper frame to a top surface of the posts.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
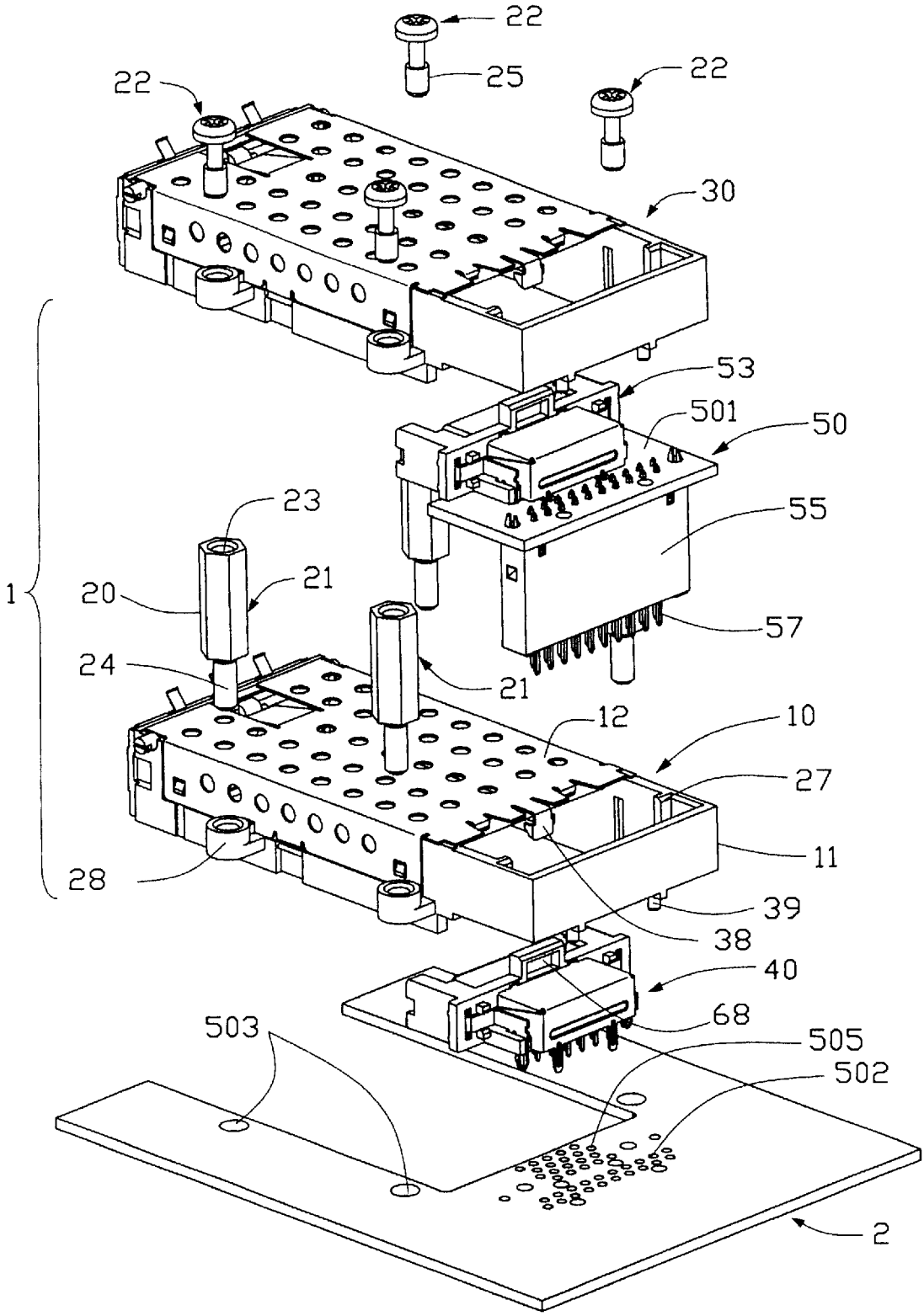
FIG. 1 is an exploded view of a guide rail assembly of the present invention for connecting optoelectronic modules to a printed circuit board.

Referring to FIG. 1, the present invention is related to a guide rail assembly 1 mountable onto a printed circuit board 2 (PCB) and adapted for receiving optoelectronic modules (not shown) therein and electrically connecting the optoelectronic modules to the PCB 2. The guide rail assembly 1 comprises a lower guide rail 10, an upper guide rail 30, a first electrical connector 40, a second electrical connector 50, and a mounting device 20. The first electrical connector 40 and the second electrical connector 50 are respectively received in the lower guide rail 10 and in the upper guide rail 30 for electrically connecting the corresponding optoelectronic modules to the PCB 2.

The mounting device 20 includes four posts 21 and four fastener members 22. Each post 21 defines an inner threaded hole 23 at an upper end thereof and forms a bolt 24 with exterior threads thereon at a lower end thereof. Each fastener member 22 defines exterior threads 25 for engaging with the inner threaded hole 23 of a post 21.

Figure 2:
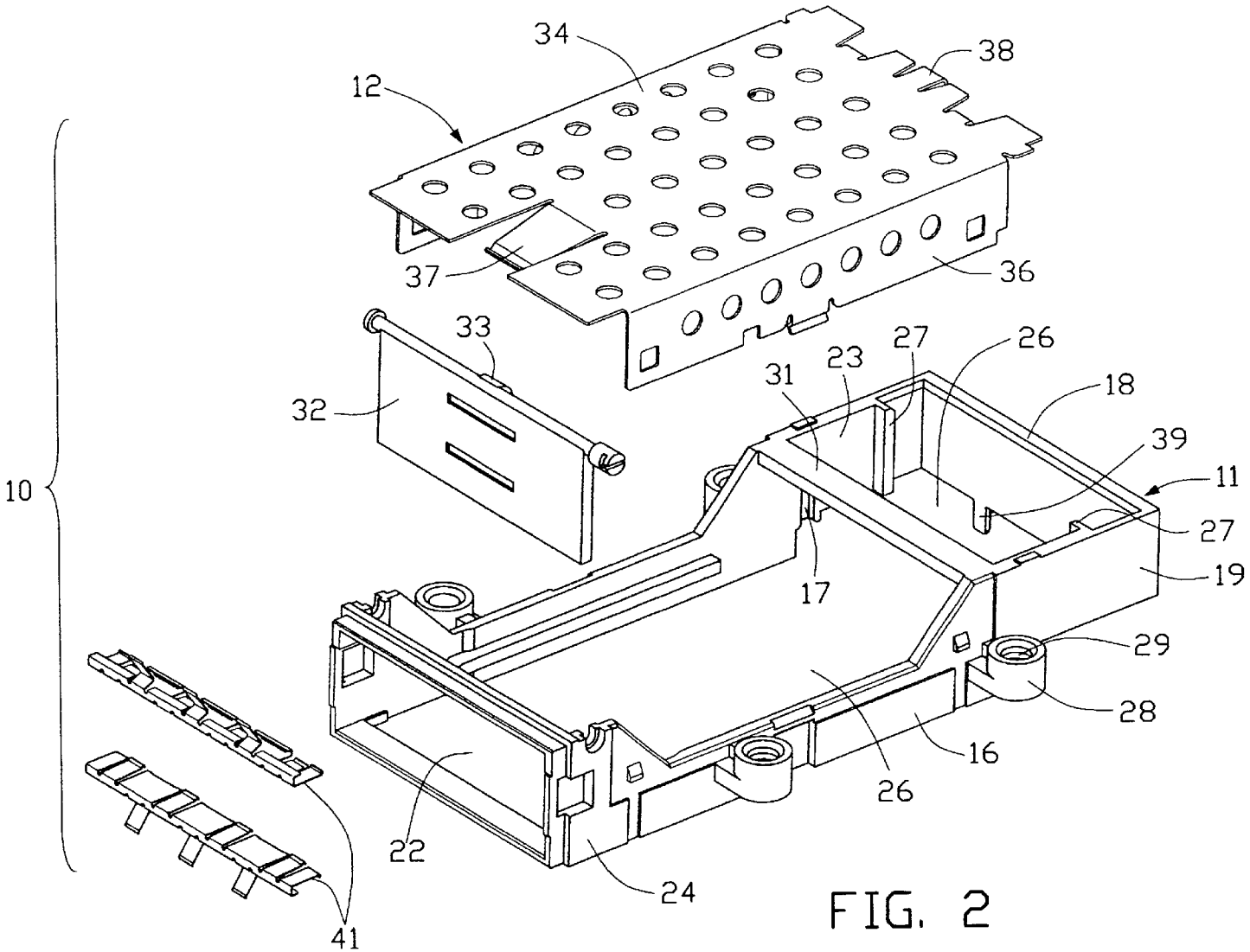
FIG. 2 is an enlarged, exploded, perspective view of a guide rail of the guide rail assembly of FIG. 1.

Referring to FIG. 2, the lower guide rail 10 is shown and comprises a conductive frame 11, a metallic cover 12, a conductive door 32, and a pair of conductive grounding plates 41. Please note that the lower and upper guide rails 10, 30 are identical to one another, but, for the sake of brevity, only the lower guide rail 10 will be described in detail.

The frame 11 is preferably made of a metallic material. It includes a pair of side beams 16, a rear beam 18 connecting rear ends 19 of the side beams 16, and a front portion 24. A port 22 is defined through the front portion 24 for entrance of the optoelectronic module. The frame 11 defines a receiving space 26 between the side beams 16 and the rear beam 18. Each side beam 16 has a rib 27 on an inner wall 23 thereof for dividing the receiving space 26 into two portions. One portion (not labeled) adjacent to the rear ends 19 is used to receive an extender 55 of the second electrical connector 50 (described further hereinafter), and the other portion (not labeled) is used to receive the optoelectronic module and the first electrical connector 40 therein. In addition, the inner walls 23 further each define a receiving slot 17 for retention of the first electrical connector 40. The frame 11 also includes two pairs of side lugs 28 at opposite sides thereof, each defining a threaded hole 29 for passage of a bolt 24 of the mounting device 20 therethrough to secure the frame 11 onto the PCB 2. (Note that the side lugs 28 defining threaded holes 29 on the upper guide rail 30 would each be for passage of a fastener member 22 therethrough to secure the frame 11 of the upper guide rail 30 to tops of the four posts 21 of the mounting device 20). A reinforcing rib 31 is connected between the two side beams 16 of the frame 11 to strengthen the frame 11. The frame 11 provides a pair of tabs 39 at a bottom thereof for pre-retention of the frame 11 onto the PCB 2.

The door 32 pivotably attaches to the front portion 24 of the frame 11 and is in a closed position relative to the port 22 before entrance of an optoelectronic module. The door 32 is pushed into an open position by entrance of the optoelectronic module. The pair of grounding plates 41 attaches to the front portion 24 of the frame 11.

The metallic cover 12 includes a plate 34 and two side portions 36 bent 90 degrees from opposite edges of the plate 34 for attaching the metallic cover 12 to the frame 11. The metallic cover 12 has a primary purpose of providing EMI protection for an optoelectronic module mounted in the frame 11. The metallic cover 12 provides an elastic arm 37 at an end thereof adjacent to the port 22 of the frame 11 for urging a portion 33 of the door 32 to a closed state relative to the port 22 after the optoelectronic module is drawn out from the frame 11. The metallic cover 12 provides a hook 38 (clearly shown in FIG. 1) downwardly extending from a rear end thereof for engaging with the connector 40.

Figure 3:
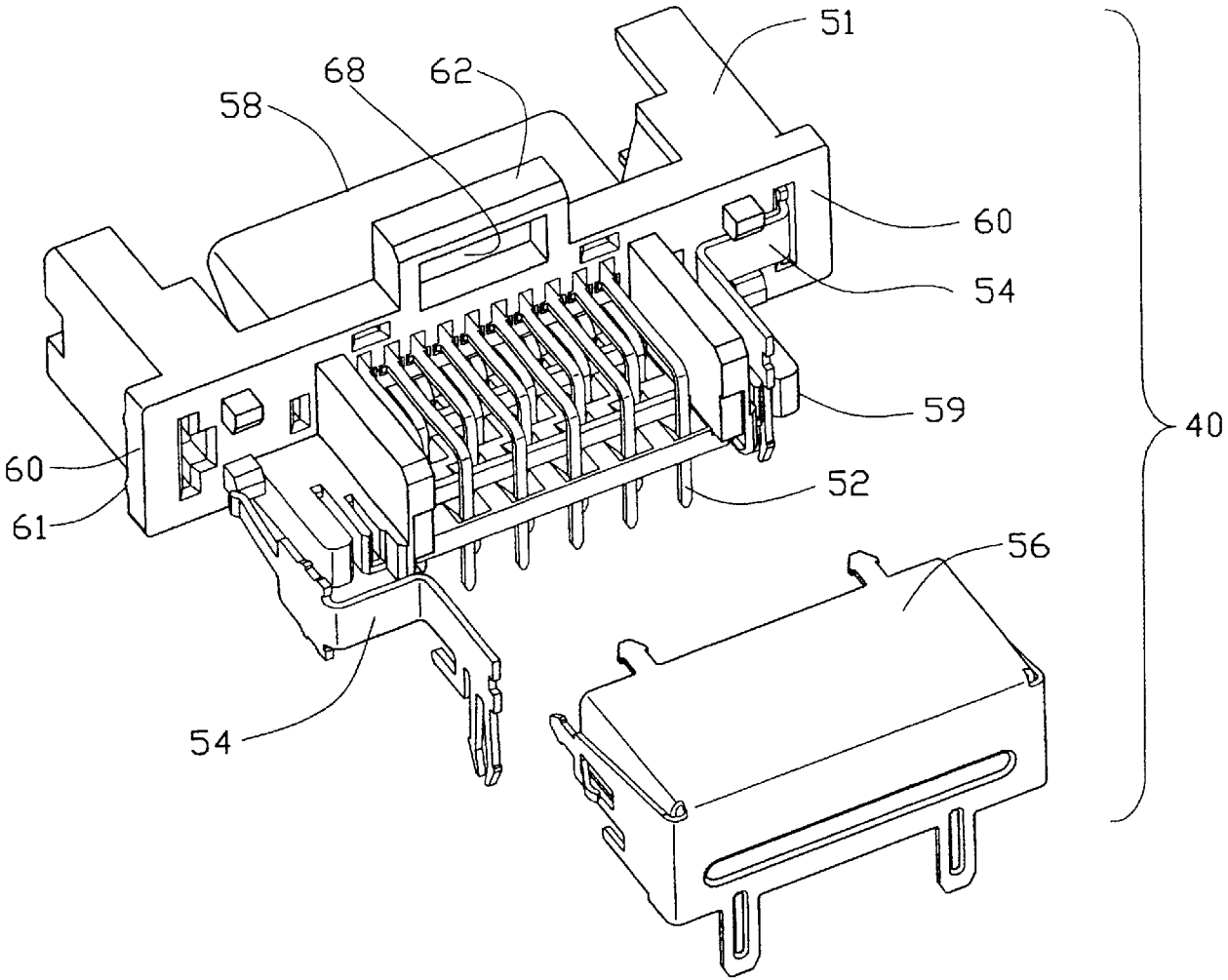
FIG. 3 is an enlarged, exploded, perspective view of an electrical connector of the guide rail assembly of FIG. 1.

Referring particularly to FIG. 3, the connector 40 includes an insulative housing 51 receiving a plurality of contacts 52 therein, a pair of conductive grounding terminals 54 fixed to opposite side sections (not labeled) of the housing 51, and a conductive EMI shell 56 attached to the housing 51 and enclosing a rear portion of the contacts 52. The connector 40 has a mating portion 58 at a front portion thereof adapted for engaging with an optoelectronic module in the frame 11 and a mounting portion 59 at an opposite rear portion thereof for mounting onto the PCB 2. The housing 51 forms a fastening rib 60 on each of two opposite side sections (not labeled) thereof and an ear portion 62 at a top thereof. The ear portion 62 defines a recess 68 for engaging with the hook 38 of metallic cover 12. Teeth 61 are formed on each fastening rib 60.

The second electrical connector 50 includes a connecting portion 53, a printed substrate 501, and an extender 55. The structure of the connecting portion 53 is identical to that of the first electrical connector 40. The extender 55 comprises an insulative extender housing (not shown), a conductive shield (not labeled) surrounding the extender housing, and a plurality of electrical pins 57 passing through and protruding beyond the extender housing (not shown). The extender housing (not shown) has the shape of a rectangular box and has four sidewalls (not shown) and a top and a bottom end walls (not shown). The conductive shield (not labeled) surrounds the four sidewalls (not shown) of the extender housing (not shown). The electrical pins 57 pass through the extender housing and project beyond the top and bottom end walls (not shown) of the extender housing (not shown). The electrical pins 57 are adapted to electrically connect the printed substrate 501 with the PCB 2.

The printed substrate 501 has a plurality of through holes for electrically connecting with contacts 52 of the connecting portion 53 and with electrical pins 57 of the extender 55. Electrical circuit traces (not shown) are printed on the surfaces (not labeled) or in an interior of the printed substrate 501. These circuit traces electrically connect the through holes for engaging with contacts 52 to corresponding through holes for engaging with electrical pins 57.

Figure 4:
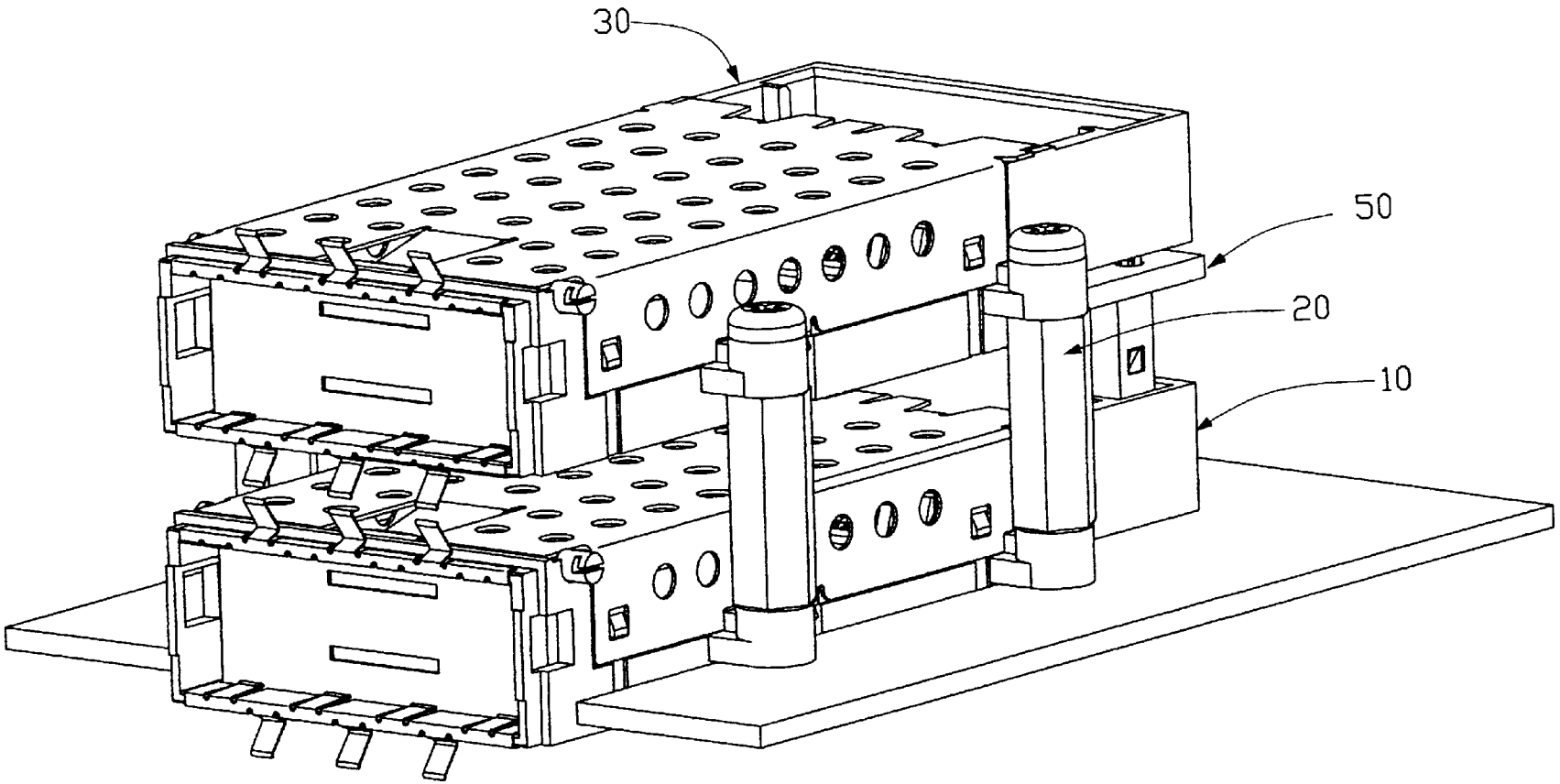
FIG. 4 is an assembled view of the guide rail assembly mounted onto a printed circuit board.

Also referring to FIGS. 1 and 4, in assembly, the first electrical connector 40 is received into the receiving space 26 of the lower guide rail 10, with the fastening ribs 60 of the housing 51 of the first electrical connector 40 being received in the receiving slots 17 of the frame 11 of the lower guide rail 10. The teeth 61 on the fastening ribs 60 securely engage with peripheral walls of the receiving slots 17. The door 32 and the grounding plates 41 are assembled to the front portion 24 of the frame 11 and the metallic cover 12 is assembled to the frame 11 with the hook 38 engaging in the recess 68 of the ear portion 62, thereby securely retaining the first electrical connector 40 in the frame 11.

The connecting portion 53 and the extender 55 are assembled to opposite surfaces (not labeled) of the printed substrate 501, the contacts 52 of the connecting portion 53 extending through and being soldered to through holes at a forward side (not labeled) of the printed substrate 501, and the electrical pins 57 extending through and being soldered to through holes at a rearward side (not labeled) of the printed substrate 501. The connecting portion 53 is then assembled upward into the frame 11 of the upper guide rail 30, with the fastening ribs 60 and teeth 61 of the connecting portion 53 having an interferential fit with the receiving slots 17 of the frame 11. The door 32, grounding plates 41, and metallic cover 12 of the upper guide rail 30 are likewise assembled to the frame 11 of the upper guide rail 30, the hook 38 engaging with the ear portion 62 of the connecting portion 53.

The lower guide rail 10 is mounted to the PCB 2 with contacts 52 of the first electrical connector 40 being inserted through and soldered to a plurality of forward through holes 505 in the PCB 2 and with threaded holes 29 aligning with large through holes 503 in the PCB 2. Bolts 24 of the posts 21 are threadedly engaged with threaded holes 29 in the side lugs 28 of the lower guide rail 10, and bolts 24 are further inserted through and soldered in large through holes 503.

The upper guide rail 30 together with the second electrical connector 50 are then assembled to the lower guide rail 10 and the PCB 2. The extender 55 is inserted through the rearward portion of the receiving space 26 of the lower guide rail 10, between the ribs 27 and the rear beam 18 of the frame 11 of the lower guide rail 10. The electrical pins 57 are inserted through and soldered to a plurality of rearward through holes 502 in the PCB 2. Threaded holes 29 of side lugs 28 on the upper guide rail 30 are aligned with inner threaded holes 23 of the posts 21. The fastener members 22 are then threadedly engaged with the threaded holes 29 of the side lugs 28 and with the inner threaded holes 23 of the posts 21, fixing the upper guide rail 30 to the posts 21.

The form of the mounting device 20 may deviate in details from that described. For instance, the threaded holes 29 of the side lugs 28 may be smooth instead of threaded, the inner threaded holes 23 may have smooth instead of threaded inner surfaces and further may have a large radius inner surface over most of its depth and a lip at an upper limit thereof with a smaller radius. Additionally, the bolts 24 may have a smooth outer surface instead of a threaded outer surface, and fastener members 22 may have a smooth-surfaced plug portion 25, in place of the previously described threaded surface 25, to securely snap past the lip of the smooth surfaced inner hole 23 just described.

The described embodiment provides a guide rail assembly with stacked guide rails which are securely attached to one PCB, providing a simpler and less expensive solution than using two PCBs. The electrical connectors 40, 50 securely engage with the frames 11 of the associated guide rails 10, 30, thereby protecting the soldered connections between the connectors 40, 50 and the PCB 2, improving reliability of the guide rail assembly over that of the prior art. Since both guide rails 10, 30 are identical, manufacture of the assembly is more straightforward and less costly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A guide rail assembly mountable onto a printed circuit board for receiving optoelectronic modules therein, comprising:

a first guide rail defining a first receiving space for receiving a first optoelectronic module therein through a front port thereof, first side lugs formed on outer walls of the first guide rail;

a second guide rail defining a second receiving space for receiving a second optoelectronic module therein, said second guide rail adapted to be stacked above the first guide rail, and having second side lugs arranged corresponding to the first side lugs of said first guide rail; and a mounting device for supporting the second guide rail over the first guide rail and including posts arranged between first and second side lugs so as to elevate the second guide rail above the first guide rail; wherein the first and second guide rails each includes a frame, and a metallic cover attached to the frame which provides EMI shielding to the corresponding optoelectronic module; wherein an end portion of each said metallic cover further includes a hook extending downward for interlocking with an electrical connector assembled to the guide rail; wherein said mounting device includes a plurality of posts and fasteners; wherein each of the first and second side lugs defines a threaded hole for passage of one post or fastener of the mounting device.

2. The guide rail assembly as recited in claim 1, wherein the first and second receiving spaces each includes a module receiving space for receiving the corresponding first or second optoelectronic module and a connector mounting space for receiving an electrical connector.

3. The guide rail assembly as recited in claim 2, wherein said frames of the first and second guide rail s each has side beams and a receiving slot is defined on an inner wall of each side beam in the connector mounting space for securing the electrical connector.

4. The guide rail assembly as recited in claim 1, wherein the first guide rail has a same design as the second guide rail.

5. A guide rail assembly mountable onto a printed circuit board and adapted for receiving optoelectronic modules therein, comprising:

a first guide rail including:

a first frame having two side beams and a rear beam connecting the side beams, a first receiving space being defined between the two side beams and the rear beam, said first receiving space including a first module receiving space for receiving a first optoelectronic module and a first connector mounting space;

a first electrical connector received in the first connector mounting space and having first fastening ribs adapted for mating with corresponding receiving slots defined in inner walls of the side beams of the first frame;

a second guide rail stacked on said first guide rail and including:

a second frame having two side beams and a rear beam connecting the side beams, a second receiving space being defined between the two side beams and the rear beam, the second receiving space including a second module receiving space for receiving a second optoclectronic module and a second connector mounting space;

a second electrical connector received in the second connector mounting space and having second fastening ribs adapted for mating with corresponding receiving slots defined in inner walls of the side beams of the second frame; wherein the first and second guide rails further include a first and second metallic cover, each forming a hook, and the first and second electrical connectors each includes an ear portion adapted to engage with the hook of the corresponding metallic cover.

* * * * *